United States Patent [19]

Baldi et al.

[11] Patent Number: 4,528,215

[45] Date of Patent: Jul. 9, 1985

[54] DIFFUSION ALUMINIZING OF COBALT-BASE SUPERALLOYS

[75] Inventors: Alfonso L. Baldi, Wynnewood, Pa.; Victor V. Damiano, Pennsauken, N.J.

[73] Assignee: Alloy Surfaces Company, Inc., Wilmington, Del.

[21] Appl. No.: 548,937

[22] Filed: Nov. 7, 1983

Related U.S. Application Data

[60] Division of Ser. No. 306,590, Sep. 28, 1981, abandoned, and Ser. No. 104,571, Dec. 17, 1979, , which is a division of Ser. No. 781,134, Mar. 25, 1977, abandoned, which is a continuation-in-part of Ser. No. 576,981, May 13, 1975, Pat. No. 4,041,196, which is a continuation-in-part of Ser. No. 507,126, Sep. 18, 1974, abandoned, which is a continuation-in-part of Ser. No. 466,908, May 3, 1974, Pat. No. 3,958,047, which is a continuation-in-part of Ser. No. 328,378, Jan. 31, 1973, Pat. No. 3,867,184.

[51] Int. Cl.[3] ..... C23C 11/00; C23C 13/00

[52] U.S. Cl. ..... 427/252; 427/253

[58] Field of Search ..... 427/253, 252, 405

[56] References Cited

U.S. PATENT DOCUMENTS

| | | | |
|---|---|---|---|
| 3,079,276 | 2/1963 | Puyear et al. | 427/253 |
| 3,594,219 | 7/1971 | Maxwell et al. | 427/405 |
| 3,801,357 | 4/1974 | Baldi | 427/252 |

*Primary Examiner*—S. L. Childs

*Attorney, Agent, or Firm*—Connolly and Hutz

[57] ABSTRACT

In the pack diffusion coating of chromium into the surface of a superalloy, the formation of undesirable oxide inclusion is reduced when the diffusion coating pack contains at least about 3% $Ni_3Al$. Also the formation of alpha-chromium is reduced when the pack diffusion is carried out in a retort effectively not over five inches in height. On the other hand an alpha-chromium-rich layer at least 0.2 mil thick can be deliberately formed and the superalloy thus coated subjected to an aluminizing treatment to convert the alpha-chromium into islands that provide very high sulfidation resistance. Pack aluminizing in the presence of chromium makes a very effective aluminum- or chromium-containing top coating over platinum plated or platinum coated nickel-base superalloys. Depletion of diffusible material from workpieces heated in a powder-pack can also provide a surface on which aluminizing produces a highly impact-resistant coating.

1 Claim, 2 Drawing Figures

DIFFUSION ALUMINIZING OF COBALT-BASE SUPERALLOYS

This application is a division of application Ser. No. 306,590 filed Sept. 28, 1981, now abandoned and that application is a division of application Ser. No. 104,571 filed Dec. 17, 1979, which is a division of application Ser. No. 781,134 filed Mar. 25, 1977 (subsequently abandoned), which in turn is a continuation-in-part of application Ser. No. 576,981 filed May 13, 1975 (U.S. Pat. No. 4,041,196 granted Aug. 9, 1977), which in its turn is a continuation-in-part of prior applications Ser. No. 507,126 filed Sept. 18, 1974 (subsequently abandoned) and Ser. No. 466,908 filed May 3, 1974 (U.S. Pat. No. 3,958,047 granted May 18, 1976). The last-mentioned two applications are continuations-in-part of application Ser. No. 328,378 filed Jan. 31, 1973 (U.S. Pat. No. 3,867,184 granted Feb. 18, 1975).

The present invention relates to the treatment of metal by diffusion coating.

Among the objects of the present invention is the provision of improved coating and treating processes and improved products thus formed. A particular object is to protect metals against corrosion or oxidation at elevated temperatures.

Figure 1:
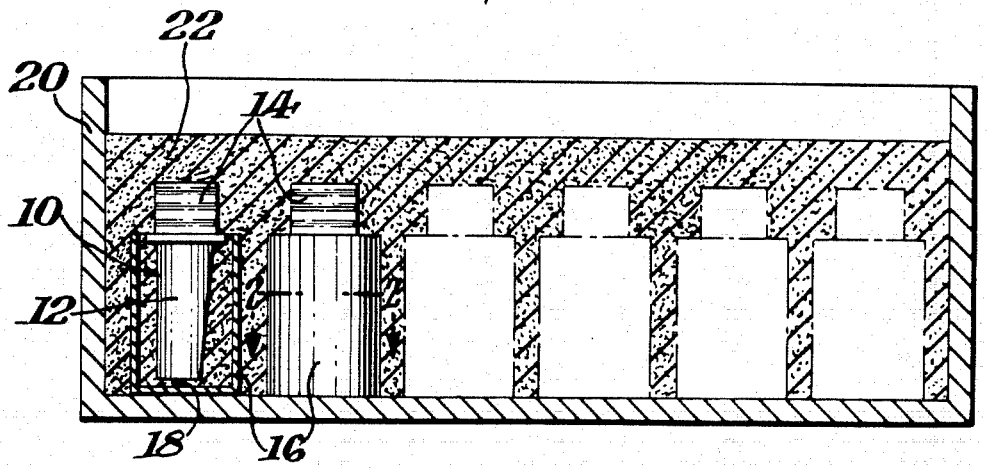
Figure 2:
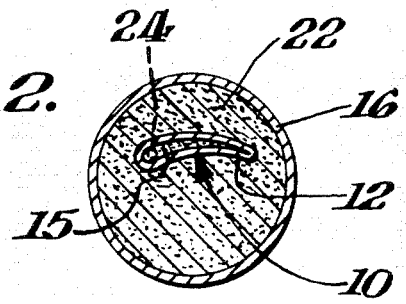

The foregoing as well as additional objects of the present invention will be more fully understood from the following description of several of its exemplifications, reference being made to the accompanying drawings wherein:

FIG. 1 is a sectional view of a packed retort for carrying out a differential coating process of the present invention; and FIG. 2 is a cross-section along line 2—2 of FIG. 1 of a workpiece packed in the retort.

It is known that superalloy articles such as turbine vanes and blades as well as burner rings in the hot section of jet engines can be diffusion coated with chromium and then diffusion coated with aluminum to improve their resistance to corrosion and oxidation at temperatures as high as 1100° C.

One very effective technique for chromizing a superalloy workpiece in preparation for the aluminizing is as follows:

EXAMPLE 1

A group of B-1900 jet engine blades was packed in a cup-shaped retort 4 inches high in an $NH_4Cl$-energized diffusion coating pack having 14% powdered chromium and 15% powdered $Ni_3Al$. The remainder of the pack was alumina, but can be any other inert material. The energizer content was ½% by weight of the total of the other pack ingredients. Chromizing was conducted in a hydrogen-bathed atmosphere, as in U.S. Pat. No. 3,764,371, with the retort loosely covered, holding a 1925° F. temperature for 20 hours, giving a very uniform chromized case about 0.7 mils deep, essentially free of oxide inclusions and without the formation of alpha-chromium phase.

In the event the $Ni_3Al$ content of the pack is omitted or is less than about 3% by weight, a substantial amount of oxide inclusions are formed in the case, and these may cause the case to spall off under the influence of repeated thermal shock treatment, particularly if their number increases to form a continuous layer of inclusions. Such inclusions tend to form in the chromium diffusion case of any superalloy containing aluminum and/or titanium. The number of such inclusions formed diminishes sharply when the $Ni_3Al$ content of the pack is at least 3% by weight, and reaches a minimum when the $Ni_3Al$ content is about 6%. As much as about 20% $Ni_3Al$ can be contained in the pack so that there is a considerable tolerance for it and a wide concentration range for its use. It is preferred to use 8 to 15% of $Ni_3Al$ so as not to require accurate measuring and also to make it unnecessary to add make-up $Ni_3Al$ after each use of the chromizing pack.

In addition to reducing oxide inclusions, the $Ni_3Al$ behaves like an inert diluent in the pack since it does not interfere significantly with the chromizing. Thus the chromium content of the pack can be as low as 10% and as high as 40%, regardless of the $Ni_3Al$ content.

The formation of oxide inclusions during chromizing is also reduced when the chromizing takes place in an evacuated atmosphere as described for example in U.S. Pat. No. 3,290,126 granted Dec. 6, 1966. In an evacuated atmosphere the chromium content of the pack should be relatively high, e.g. from about 25 to about 60% by weight to keep the chromizing time from exceeding 30 hours, and the energizer should be a nonvolatile halide.

The foregoing reduction in oxide inclusion and alpha-chromium phase formation is also obtained when other nickel-base superalloys are substituted for the B-1900 alloy of Example 1. The B-1900 composition is given in U.S. Pat. No. 3,622,391, and alternative superalloys include any alloy having 50 to 75% nickel and a little aluminum or titanium. Also the $Ni_3Al$ can be replaced by intermetallics ranging from $Ni_{3.5}Al$ to $Ni_2Al$ with equivalent results.

When chromizing the foregoing superalloys at atmospheric pressure or at somewhat above atmospheric pressure there is a tendency to form alpha phase chromium on the chromized superalloy workpiece even when the chromium pick-up is as low as 1 to 3 milligrams per square centimeter of surface. Such alpha phase formation is helpful in that after a subsequent aluminizing coated members have greater resistance to corrosion, as much as three or more times the resistance to corrosion in hot sulfidizing atmospheres. However the alpha-chromium tends to be brittle and does not provide a good surface for receiving vapor-deposited top coatings such as that described in U.S. Pat. No. 3,676,085. By using a cup-shaped retort effectively not over 5 inches in height as described in Ser. No. 576,981, the formation of alpha-chromium phase is prevented. Retort cups taller than 5 inches can be effectively used without alpha-chromium formation by perforating the side wall of the retort at a level within 5 inches of its bottom. The perforations can be ⅛ inch diameter holes drilled through the retort wall to provide venting about 1 to 2 square inches in cross-sectional area for every pound of diffusion coating pack. Small holes such as those ⅛ inch in diameter generally do not permit any significant amount of the pack to spill out through them, but larger size holes can be used and covered by a wire screen when the retort is being loaded.

It is preferred to maintain an effective retort height of at least two inches, as by providing the foregoing venting at least two inches up from the bottom of the retort. It should also be noted that such venting is not to the air but to the space that surrounds the inner retort. That space is bathed by a stream of hydrogen, but can instead be bathed by a stream of inert gas like argon, during the chromizing. In general, reduction in alpha phase formation is obtained with any chromium-diffusion pack and does not require the presence of any of the foregoing nickel aluminide intermetallics in the pack. However the presence of 3% of more of such intermetallic in the pack will even further reduce the tendency to form alpha-chromium. Modifying Example 1 by replacing its retort with an unperforated retort cup 10 inches high will provide a chromized case about 1.5 mils thick with a substantial content of alpha phase chromium and suitable for subsequent aluminizing to make an excellent product that without further treatment has unusually good sulfidation resistance.

The diffusion aluminizing that follows the diffusion chromizing can be either an inhibited or an uninhibited aluminizing. The uninhibited aluminizing is conducted with no more than a slight amount of chromium, or none at all, present in the aluminizing pack. A chromium content about half that of the aluminum, by weight, inhibits the aluminizing by greatly reducing the aluminum coating rate and is described for instance in U.S. Pat. No. 3,257,230. As pointed out in that patent, larger proportions of chromium to aluminum can also be used in the inhibited aluminizing, and proportions greater than 3:1 by weight cause some of the chromium to diffuse into the aluminized case along with the aluminum.

A very effective combination of the foregoing coatings is illustrated in the following example.

EXAMPLE 2

First hot stage jet engine vanes, some made of Rene 77 alloy and some of Rene 80 alloy were packed in a powder coating pack in a 10-inch high retort. The pack had the following composition, by weight:

| | |
|---|---|
| Very fine chromium (20 micron size or less) | 45% |
| Pre-fired mixture of: | |
| 49.2 parts $Al_2O_3$ | |
| 42.8 parts Ni | |
| 6.5 parts Al | |
| 1.5 parts Cr | 55% |
| $NH_4Cl$ energizer | 0.5% of the foregoing |

The entire pack had been prefired at 1925° F. for 5 hours and its energizer content brought up to the designated amount with fresh $NH_4Cl$.

After the packing is completed the retort is loosely covered and heated in a hydrogen-bathed atmosphere as described in Example 1, to 1925°–1975° F. where it is kept for 10 hours. After blasting with fine glass powder, both alloys show a 1.5 mil thick diffusion coating case the outermost third of which is rich in alpha-chromium. The thus-coated workpieces are then given an inhibited aluminizing treatment as described in Example I of U.S. Pat. No. 3,801,357, but without the masking there referred to. A 10-hour aluminizing carried out in that manner at 1950° F. produces a total diffusion coating case about 3 mils thick on the Rene 77 alloy and about 2.5 mils thick on the Rene 80 alloy. These coated members are unusually resistant to sulfidizing corrosion at temperatures of 1900° F.

The foregoing Rene alloys are nickel-base superalloys having the following approximate compositions in percent by weight:

| | Ni | Cr | Co | Mo | W | Al | Ti | C | B | Zr |
|---|---|---|---|---|---|---|---|---|---|---|
| Rene 77 | 58 | 14.6 | 15 | 4.2 | 0 | 4.3 | 3.3 | 0.07 | 0.016 | 0.04 |
| Rene 80 | 60 | 14.0 | 9.5 | 4. | 4.0 | 3. | 5.0 | 0.17 | 0.015 | 0.03 |

Similar results are also obtained with other nickel-based superalloys as well as with cobalt-base superalloys.

Chromium-inhibited aluminizing is particularly desirable as a top coating over a platinum diffusion or electroplated coating on nickel-base superalloys, and in such a combination provides greater sulfidation resistance at high temperatures than the use of the uninhibited aluminizing in such a combination as described in U.S. Pat. No. 3,677,789 granted July 18, 1972. The same advantage is obtained when other platinum metals, particularly palladium, are used in place of platinum. Additional suitable examples of chromium-inhibited aluminizing are described in Canadian Pat. No. 806,618 issued Feb. 18, 1969, as well as in U.S. Pat. No. 3,257,230. The nickel-base superalloys are also described in those patents and generally are those high temperature alloys which contain at least about 50% nickel and about 6 to 25% chromium.

The following coating illustrates this coating combination:

EXAMPLE 3

A jet engine (hot section) blade of B-1900 alloy and electroplated with a 0.0003 inch thick layer of platinum was subjected to a hydrogen-bathed pack diffusion coating at 1890° F. for 12 hours, in a previously used pack consisting of, by weight:

| | |
|---|---|
| magnesothermic chromium powder | 45% |
| alumina (−325 mesh) | 45% |
| aluminum powder (−325 mesh) | 10% |

activated with ½% $NH_4Cl$.

The thus treated blade has a 0.003 inch thick diffusion case and also shows exceptional hot sulfidation resistance.

Other types of very finely divided chromium less than 10 microns in size can be used in place of the magnesothermic powder in the foregoing example.

Similar hot sulfidation resistance is obtained for DS nickel if it is first chromized, as described in U.S. Pat. No. 3,785,854 for example, then given a thin platinum overcoating as by electroplating or vapor condensation, and then aluminized as also described in U.S. Pat. No. 3,785,854. Thus a 4 to 6 mil chromized case with a 0.2 to 0.3 mil platinum layer and a 1 mil inhibited aluminizing case makes a very effective coating combination for a DS nickel burner ring.

DS nickel is the preferred designation for nickel that is stregthened by having dispersed in it about 2 weight percent of finely divided thorium oxide or the like. TD nickel was previously used as such designation.

Diffusion coatings can also be applied so that some portions of a workpiece contain a thinner coating than other portions. Thus roots or hollow interiors of turbine blades can be arranged to be diffusion coated at the same time the remainder of the blade is diffusion coated, but with less coating than the remainder of the blade. The following example is typical:

EXAMPLE 4

A set of hollow first stage turbine blades of B-1900 alloy had their hollow interiors filled with the following aluminizing pack:

Inside Pack

45% chromium
10% aluminum
Balance alumina plus ½% $NH_4Cl$

The blades so filled were packed in an aluminizing pack containing:

Outer Pack

10% chromium
11% aluminum
1.4% silicon
Balance alumina plus ½% $NH_4Cl$

All ingredients were −200 mesh. A retort so packed was then subjected to a hydrogen-bathed coating heat at 1800° F. for 5 hours, and after clean-up the blades showed a 4.3 milligram per square centimeter pick-up of aluminum on their interior surfaces, with a 10.2 milligram per square centimeter aluminum pick-up on their exterior surfaces. Similar results are obtained whether or not the foregoing packs are given a break-in pre-firing.

In the same way the roots of blades or buttresses of vanes or trailing edges of both blades and vanes can be given coatings thinner than the remainder of the blades or vanes. Reducing the chromium content of the internal pack to 20% increases the internal coating weight. An increase in outer coating is obtained by reducing the chromium content of the outer pack or increasing its aluminum or silicon content.

Conversely, increasing the chromium content of the inner pack to 60% further diminishes the internal coating weight.

Without the chromium in the outer pack the silicon in that pack only slightly diminishes the magnitude of the aluminum it deposits, and without the silicon the changes in chromium content of the outer pack have been much less effect. The combination of the chromium, silicon and aluminum provides the coating control when the aluminum content of the pack is as little as 3% and as much as 20%, with the chromium content greater than, preferably about 1.5 to 3 times, that of the aluminum, and the silicon content about 10 to 20% that of the aluminum. The coating temperatures can vary from about 1600° F., preferably 1700° F., to about 2200° F., and the workpieces can be any metal that is not melted at the coating temperature, such as any nickel- or cobalt-based superalloy, DS nickel, DS nichrome, chromium-containing iron, and type 300 and 400 stainless steels.

Omitting the chromium or the silicon or both the chromium and the silicon from the outer pack greatly increases the rate at which the aluminum deposits on the surface of the workpiece.

Nickel can also be used in the diffusion coating pack in place of chromium and/or silicon to inhibit the rate at which an aluminum diffusion coating forms.

The B-1900 alloy turbine blades are preferably heat treated at 1975° F. for four hours followed by rapid cooling at least as fast as air cooling to below 200° F., with a subsequent ageing at 1650° C. for 10 hours and a final rapid cooling, in oder to develop their best mechanical properties. These heat treating steps can be carried out during the duffusion treatment to differentially coat, by using the snugly fitting containers and procedure described in U.S. Pat. No. 3,824,122 granted July 14, 1974.

Another technique for simultaneously applying two different diffusion coatings is to use different energizers. This is illustrated by the following example:

EXAMPLE 5

The same B-1900 blades of Example 4 had their interiors filled with the following diffusion coating pack:

Inside Pack 18.5% $Ni_3Al$
18% Aluminum
47% Co
15.5% Cr
0.5% $NH_4Cl$

The thus filled blades were packed in the following pack:

Outer Pack 18.5% $Ni_3Al$
18% Alumina
46.5% Co
15% Cr
2% $NH_4I$

Using a 2000° F. coating temperature for ten hours in a hydrogen-bathed atmosphere produced an internal coating which was essentially a chromized case containing a negligible amount of cobalt. On the other hand the outer coating was a case that contained more cobalt than chromium and, after an aluminum top coat, provided a somewhat greater resistance to high temperature oxidation. The two cases had approximately the same thickness. It will be noted that the $Ni_3Al$ in these formulations acted as inert diluent and can be replaced by other nickel aluminides as pointed out above, or by alumina where the formation of oxide inclusion is not objectionable or when the chromizing is effected under subatmospheric pressure.

Mixing the two energizers ($NH_4Cl$ and $NH_4I$ or their equivalents) enables the application of diffusion coatings of intermediate composition. Thus a mixture of 0.5% $NH_4Cl$ and 0.5% $I_2$, both by weight, provides a coating containing almost as much cobalt as chromium. $NH_4Br$ can be used as energizer in place of chloride, the bromide acting very much like the chloride. Other volatilizable compounds of chlorine, bromine and iodine can be used as energizers with similar results so long so there is sufficient chromium and cobalt in the pack to provide the coatings. At least about 10% of each of these metals by weight based on the total metal content of the pack is all that is needed, and it is preferred to have at least about 15% inert filler by weight; without filler the pack tends to sinter together at temperatures of 2000° F. or higher.

The wall of the blades of Example 5 does a good job of keeping the diffusion coating atmosphere on the outside of each blade from affecting the diffusion coating atmospheres in the interiors of the blades. Where the different coatings of Example 5 are to be applied to adjacent portions of the outer surfaces, these portions can be effectively separated by a metal wall separating one pack from the other.

Where the pack on one side of such a separating wall has a tendency to vent its activator vapors into the pack on the other side of the wall, as can happen with the foregoing hollow blades when the opening into their hollow interiors is so located that it is submerged in the external pack, it is preferred to have more activator present in the external pack than in the internal pack, and to have a very small amount of activator in the internal pack, for example ¼ to ½% by weight of the pack. Even such a small amount produces substantial excess vapor on heat-up and such vapor is vented out the opening for the hollow interiors. The effect of such vapors in contaminating the activator vapors generated in the external pack is reduced by keeping the activator content low in the internal pack, and swamping any vapors vented into the external pack by a larger activator content in the external pack as well as by the use of much more external pack than internal pack.

As in the case of simple diffusion coating packs, the inside and outer packs of Example 5 can be reused. It is desirable for such reuse to replenish the packs for so much of their contents as have been consumed in a coating operation. This keeps the pack fairly uniform in composition so it is not necessary to make many adjustments for such reuse or even for repeated reuse. Inasmuch as the activator is fairly thoroughly driven off during any diffusion coating operation, an inside pack can be used as an outer pack or vice versa, the amount and nature of the activator being selected to match the nature of the reuse rather than the past history of the pack. If it is no trouble to adjust the coating conditions for reuse without replenishment, this can also be done.

The packs of Examples 1 through 4 can also be similarly reused with or without replenishment.

The foregoing chromium and cobalt-chromium coatings are particularly suited for application at temperatures of at least 1700° F. to protect nickel-base superalloys against high temperature oxidation and sulfidation, in which event it is preferred to apply over these coatings a diffusion coating of aluminum or a coating of aluminum-chromium mixtures such as those described in U.S. Pat. Nos. 3,528,861 and 3,676,085. For these purposes the differential coatings are preferably applied with the use of a retort effectively not over five inches high.

The following additional examples show modified forms of differential diffusion coating:

EXAMPLE 6

Jet engine hot section blades composed of PWA-1422 and with hollow interiors, were coated so the outer air foil surface had a heavy aluminized case and the root a thin aluminized case, with the interiors uncoated. This alloy has the following composition:

| | |
|---|---|
| Chromium | 9% |
| Cobalt | 10% |
| Titanium | 2% |
| Colombium | 1% |
| Aluminum | 5% |
| Tungsten | 12.5% |
| Carbon | 0.15% |
| Boron | 0.015% |
| Zirconium | .05% |
| Hafnium | about 1% |
| Nickel | Balance |

To make sure the blades were clean their external and internal surfaces were first solvent cleaned in trichloroethylene, then dry blasted with 220 grit aluminum oxide propelled by air at a pressure of 30 psig. Any residual abrasive was then blown off the blades. The interiors of the blades were then filled with the masking composition made up of equal parts by weight of $Ni_3Al$ and alumina to which mixture is added metallic chromium so that its concentration is 1.6% by weight, all ingredients being −240 mesh. The blades were then packed in individual retort arrangements.

The outer air foil section of each blade was packed in a closely fitting pre-aluminized plain carbon steel tube with the following heavy coating pack composition (all percentages by weight):

20% chromium powder the particles of which range in size from about 1 to about 10 microns,
11%–250 mesh aluminum-silicon alloy containing approximately 88% aluminum and 12% silicon,
68.5% 325 mesh aluminum oxide,
0.5% ammonium chloride.

The packing was as illustrated in FIGS. 1 and 2 where each blade is shown at 10, its air foil section at 12, its root at 14, the masking pack at 15, the opening through which the masking pack is inserted at 24, the pre-aluminized steel tube at 16, and the heavy coating pack at 18. It was then placed in a large retort 20 and a number of additional blades similarly prepared were placed alongside it in that retort. Over this assembly in the retort there was poured the following light coating pack 22 (all percentages by weight):

45% of the same chromium powder used in the heavy coating pack,
15% 325 mesh aluminum powder,
39.5% 325 mesh aluminum oxide,
0.5% ammonium chloride.

Before the packing each of the packs was broken in by heating to 1600° F. or higher for 5 hours, after which the ammonium chloride content of the packs was returned to its original value by supplemental additions.

A number of retorts 20 were then piled up within an outer retort as described in U.S. Pat. No. 3,764,371, and heated by a surrounding furnace under a hydrogen atmosphere to 1650° F. plus or minus 25° F., which temperature was held for four hours. The assembly was then cooled under hydrogen, the hydrogen subsequently flushed out and the retorts opened and unloaded. The individual blades still with their air foil sections packed in tube 16, were then removed from the outer pack, a process which is easily accomplished inasmuch as the relatively low treatment temperature does not cause the pack particles to adhere together very tightly. The individual blades were then withdrawn from the individual tubes, and the masking mixtures in the hollows of the blades were finally poured out through the same air-cooling openings 24 used for introducing that mixture. With the help of a blast of air all residual packing and masking powder was blown off and the blades thus cleaned next placed in a furnace where they were heated under dry hydrogen to 1975° F. at which temperature they were held for four hours, following which they were rapidly cooled down with the help of a hydrogen flush to about 300° F. over a one hour period. They were then heated in air, argon or hydrogen or other inert atmosphere at 1650° F. for ten hours to complete their preparation for use. The average case depth for the outer air foil surface was 3.6 mils and the average case depth for the roots was 1.8 mils.

Essentially the same results are obtained when the workpieces are completely packed in individual snugly fitting retort tubes as described in U.S. Pat. No. 3,824,122 and subjected to the heat treatment sequence while still in those tubes and during the coating step, as also described in that patent.

When coating with a diffusion coating pack in which the metal content is aluminum, or a mixture of aluminum and silicon, a prior break-in heat with such pack is not needed.

Using the manipulative technique of Example 6 or the alternative technique described in U.S. Pat. No. 3,824,122, the process of Example 6 can be modified so the interior surface of the blade is also coated, by substituting for the masking pack the light coating pack used around the root. Three different coatings can be simultaneously applied by using the chromizing packs of Example 5 against the root and outer air foil surface of a hollow blade, while aluminizing its interior surfaces. Thus the inside pack of Example 5 can be applied to the root, the same pack but with its $NH_4Cl$ replaced by an equal quantity of $NH_4I$ used against the outer air foil surface, and the lighter aluminizing pack of Example 6 packed in the hollow interior of the blade. The blade thus coated is particularly suited to receive on its outer air foil surface and on its root surface the top coating of U.S. Pat. Nos. 3,528,861 or 3,676,085.

Alternatively the root surface is masked and the interior surface of the air foil given the light aluminum coating while the external surface of the air foil the heavy coating. A still further alternative is to subject the external surface of the air foil to the coating treatment described in U.S. Pat. Nos. 3,528,861 or 3,676,085 while the internal surface of the air foil is masked and the root subjected to the light coating of Example 4. If desired the coating of U.S. Pat. Nos. 3,528,861 or 3,676,085 can be applied in this combination after the diffusion aluminizing of the root, and directly to the external surfaces of the air foil, or after those external surfaces have been given a heavy or light aluminizing.

The following are further examples of differential coating:

EXAMPLE 7

A row of jet engine vanes made of cobalt-base superalloy X-40 is packed in an Incoloy 800 retort with their external air foil surface embedded in the following powder pack mixture (by weight):

| | |
|---|---|
| Aluminum | 10% |
| Chromium (very fine particles) | 30% |
| Alumina | 59.5% |
| $NH_4Cl$ | 0.5% |

The pack mixture had been prefired, a treatment that drove off essentially all the original $NH_4Cl$, and an additional quantity of fresh $NH_4Cl$ mixed with the prefired material after it had cooled down.

The packing was effected by aligning the vanes so the buttresses at each vane end were on the left and right of the row of vanes. The powder pack beyond the buttresses was then sucked away by a vacuum cleaner with a small nozzle, leaving the far surfaces of the buttresses uncovered.

Against these uncovered surfaces is then poured and tamped down the following powder pack mixture (by weight):

| | |
|---|---|
| Aluminum | 10% |
| Chromium (very fine particles) | 45% |
| Alumina | 44.5% |
| $NH_4Cl$ | 0.5% |

This pack mixture had also been prefired and had had its $NH_4Cl$ replenished. The final assembly is then subjected to diffusion coating conditions in a glass-sealed retort assembly at 2050° F. for twenty hours. After cooling to 200° F. the glass seal is broken and the retort emptied. The vanes are cleaned with a light blasting by very fine glass microspheres blown by a stream of air from a 10 psig supply, and are beige-colored, showing that they are coated all over. However the coating on the end faces of the buttresses measures about 2.5 mils in case depth, whereas the air foil surface coating measures about 3.5 mils in case depth.

Limiting the diffusion coating treatment so that the heating of the packed retort is at 1950° F. for 16 hours produces an outer buttress coating case of about 1.5 mils and an air foil coating case of about 2.5 mils.

EXAMPLE 8

First stage hot section jet engine blades of PWA 663 alloy have their air foil surfaces embedded in the following diffusion pack:

15% chromium powder
10% powdered aluminum-silicon alloy containing 88% by weight aluminum
balance $Al_2O_3$ powder activated with ½% ammonium chloride.

The roots of the vanes as well as their hollow interior surfaces are packed in the following pack which provides a thinner case:

45% powdered chromium
15% powdered aluminum
balance $Al_2O_3$ powder activated with ½% ammonium chloride.

The vanes so packed are subjected to a diffusion coating heat where they are held at 1600° F. for 4 hours in a hydrogen bathed atmosphere. The resulting coating on the air foil surface is from 3 to 4½ mils thick while the coating on the remaining surfaces can range from ½ to 2½ mils thick. A 1650° F. treatment for 7 hours is even more desirable. The composition of PWA 663 alloy is shown in U.S. Pat. No. 3,622,391 as being the same as that for the B-1900 alloy.

A similar differential coating can be applied to other nickel-based superalloys, such as PWA 1422, but for such alloys the diffusion coating temperature can be increased to 1670° F., and the time at that temperature can be reduced to 3 hours or even less. The nickel-based alloys so coated are preferably post-diffused at 1975° C. for from 4 to 8 hours in a hydrogen atmosphere after they are removed from the coating pack, and then air cooled at 40° F. per minute or faster down to a temperature at least as low as 1000° F.

EXAMPLE 9

First stage hot section blades of a jet engine, which blades are also made of PWA 1422 alloy are coated in the following pack:

8.8% powdered aluminum
1.2% powdered silicon
15% powdered chromium
balance $Al_2O_3$ powder activated with ½% ammonium chloride while the hollow internal surface of the blades and their roots are coated in the following mixture:

8.8% powdered aluminum
1.2% powdered silicon
30% powdered chromium
balamce $Al_2O_3$ powder activated with ½% ammonium chloride The coatings thus produced at the temperatures given in Example 8 are about the same thickness as the coatings in Example 8.

The coating packs of Example 9 can also be used to differentially coat nickel-based alloy vanes of PWA 1455. This alloy is effectively coated at 1620° to 1670° F. for 3 hours, post-diffused and air cooled as described above for B-1900, then aged at 1650° F. in air or hydrogen for 10 hours, and then cooled at a rate of at least 35° F. per minute to below 1000° F.

Similar results are obtained with alloys modified by the addition of 1 to 1.5% hafnium to increase ductility and yield strength, as well as diminish high temperature creep.

For even greater engine life the superalloys coated as in Examples 4 through 9 can have their diffusion-coated air foil surface given a top coating of the Co-Cr-Al-Y alloy as described in U.S. Pat. No. 3,676,085, and their internal surfaces as well as their roots can be kept masked during such top coating.

When pack diffusion coating a relatively small portion of a workpiece surface, as for instance to touch up a defective spot having an area up to about 10% of a prior coating in the manner shown in FIGS. 2 and 3 of U.S. Pat. No. 3,801,357 granted Apr. 2, 1974, the remaining surfaces can be kept from excessive deterioration through surface loss of critical alloying ingredients, by packing in an essentially inert pack containing a depletion-reducing amount of those critical ingredients as explained in U.S. Pat. No. 3,958,047.

Depletion of diffusible material from a workpiece surface can also be beneficial. As noted in U.S. Pat. No. 3,647,517 granted Mar. 7, 1972, aluminide coatings diffused onto the surface of cobalt-base superalloy workpieces are generally quite brittle, so that the protection provided by those aluminide coatings leaves something to be desired. However pretreating the workpieces so as to effect substantial diffusion depletion from those surfaces then causes an aluminide coating subsequently applied to be much less brittle.

The following is a typical example:

EXAMPLE 10

A group of Mar-M-509 jet engine turbine vanes was packed in a plain carbon steel retort in a powder pack of equal parts by weight 325 mesh alumina and finely divided nickel the particles of which are about 40 microns in size. The pack is activated with about ½% by weight ammonium chloride and the retort so packed is heated in hydrogen to a temperature of 2,000° F. for 20 hours. The hydrogen atmosphere was provided as shown in U.S. Pat. No. 3,764,371.

At the completion of the heating the retort was permitted to cool and the cooled vanes removed from the pack. These vanes showed a weight loss of about 35 milligrams per square centimeter over their entire surface, and a typical cross section of a vane showed on microscopic examination a significant number of voids adjacent the surface that was in contact with the pack.

The resulting vanes were then given a chromium-inhibited aluminum diffusion coating from a diffusion coating pack in accordance with Example 3, but with the maximum heating temperature at 2050° F. maintained for 20 hours. The final vanes had an aluminized case approximately 6 mils deep which exhibited unusually high resistance to impact damage. The same aluminizing carried out on a non-depleted Mar-M-509 vane provides an aluminized case only about 3 mils thick and very brittle.

The Mar-M-509 alloy is a well known cobalt-base superalloy and its composition is given in U.S. Pat. No. 3,647,517. Other cobalt-base alloys such as the additional five listed in Table 1 of the last-mentioned patent also lend themselves to this improved procedure for coating with an impact-resistance protective aluminide case. In each instance the depletion should provide a weight loss from about 3 to about 75 milligrams per square centimeter of surface. No scale is formed on the workpiece surface as a result of the depleting step, and the scale removal operation referred to in U.S. Pat. No. 3,647,517 is not needed.

Instead of nickel alone as the metallic ingredient of the depleting pack, alloys of nickel with aluminum for example can be used, although a proportion of aluminum larger than that in $Ni_3Al$ is not desired. The nickel or nickel alloy can also be replaced by cobalt, and any of these metals can be present in the depleting pack in a proportion of from about 10 to about 90% by weight, the remainder of the pack being either alumina or any other inert diluent such as magnesia, to keep the metal particles from sintering together. It is preferred that the metal particles be no greater than about 200 microns in size.

The retort can be of steel, stainless steel or nickel-base alloys, and its composition does not seem to affect the process so long as it does not contain low melting metals such as zinc.

The pack activator can be any halide diffusion activator including ammonium iodide, ammonium bromide, ammonium bifluoride, elemental iodide or bromine, etc., and its content can be as low as ⅛th of 1% of the pack by weight. The depleting temperature to which the cobalt-base superalloy or pieces are subjected in contact with the pack can be as low as 1600° F. or as high as 2200° F., and the depleting times can be as little as 2 hours to as much as 100 hours, the longer times being used with the lower temperatures and vice versa.

Instead of hydrogen atmosphere during the depletion, the atmosphere can be of inert gas such as argon. The activator provides a halide vapor upon heat-up and such vapor accelerates the depletion in much the same manner as it accelerates the diffusion coating of workpieces.

The more impact-resistant aluminized cobalt-base superalloy vanes and the like made in the foregoing manner are particularly desirable for use in jet engines such as those in aircraft where these articles are subject to impact damage, and make long-lived first stage hot section vanes.

Nickel-base superalloys also show the foregoing depletion when subjected to the foregoing diffusion depletion action, but protective diffusion aluminized cases on nickel-base superalloys are not nearly as brittle as those on cobalt-base superalloys, so that the aluminizing of the depleted nickel-base superalloys provides a case with only a little more impact resistance as compared with the aluminizing of untreated nickel base superalloys.

Obviously many modifications and variations of the present invention are possible in the light of the above teachings. It is therefore to be understood that within the scope of the appended claims the invention may be practiced otherwise than as specifically described.

What is claimed:

1. In the method of forming a relative ductile aluminide protective coating on a cobalt-base superalloy workpiece, the improvement according to which the workpiece is subjected to the high temperature action of a halide-activated powder pack consisting essentially of nickel and an inert diluent in an otherwise essentially inert atmosphere to cause the workpiece to lose about 3 to about 75 milligrams of weight per square centimeter of its surface, and subjecting the resulting workpiece to an aluminum diffusion coating treatment.

* * * * *